US009515394B2

(12) United States Patent
Kusuhara et al.

(10) Patent No.: US 9,515,394 B2
(45) Date of Patent: Dec. 6, 2016

(54) INSULATION DISPLACEMENT CONTACT AND CONNECTOR

(71) Applicant: Tyco Electronics Japan G.K., Kanagawa (JP)

(72) Inventors: Toshitaka Kusuhara, Kanagawa-ken (JP); Akira Kubo, Kanagawa-ken (JP); Yoshihiko Kodaira, Kanagawa-ken (JP); Yoshihiko Shino, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/699,084

(22) Filed: Apr. 29, 2015

(65) Prior Publication Data

US 2015/0236433 A1 Aug. 20, 2015

Related U.S. Application Data

(63) Continuation of application No. PCT/JP2013/005908, filed on Oct. 3, 2013.

(30) Foreign Application Priority Data

Oct. 31, 2012 (JP) ..... 2012-240798

(51) Int. Cl.
*H01R 11/20* (2006.01)
*H01R 4/24* (2006.01)
*H01R 4/48* (2006.01)

(52) U.S. Cl.
CPC ..... *H01R 4/2466* (2013.01); *H01R 4/48* (2013.01)

(58) Field of Classification Search
CPC ..... H01R 4/2466; H01R 4/48; H01R 4/24
USPC ..... 439/395, 404, 408
See application file for complete search history.

(56) References Cited

U.S. PATENT DOCUMENTS 3,990,762 A * 11/1976 Lemesle ..... H01R 4/2429 439/395

FOREIGN PATENT DOCUMENTS

| | | | |
|---|---|---|---|
| JP | 6150987 | A | 5/1994 |
| JP | 8148193 | A | 6/1996 |
| JP | 10321267 | A | 12/1998 |
| JP | 1107988 | A | 1/1999 |
| JP | 2007115429 | A | 5/2007 |

OTHER PUBLICATIONS

International Search Report, International Application No. PCT/JP2013/005908, dated Dec. 17, 2013, 2 pages.

* cited by examiner

*Primary Examiner* — Javaid Nasri
(74) *Attorney, Agent, or Firm* — Barley Snyder

(57) ABSTRACT

An insulation displacement connection contact has a base plate extending along a longitudinal axis and having a mating end and an opposite terminating end. The base plate has a contacting portion positioned proximate to the mating end, a plate-like wire supporting portion integrally extending outward from the base plate at the terminating end, and an insulation displacement connection member positioned between the contacting portion and the wire supporting portion, proximate to the terminating end.

19 Claims, 8 Drawing Sheets

Fig. 5(A)
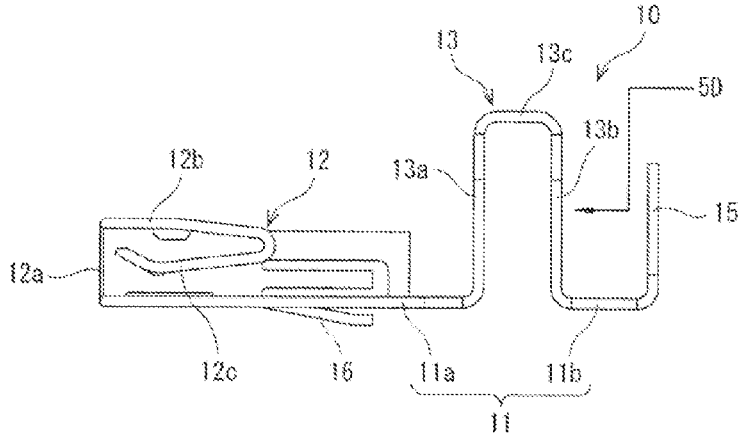
Fig. 5(B)
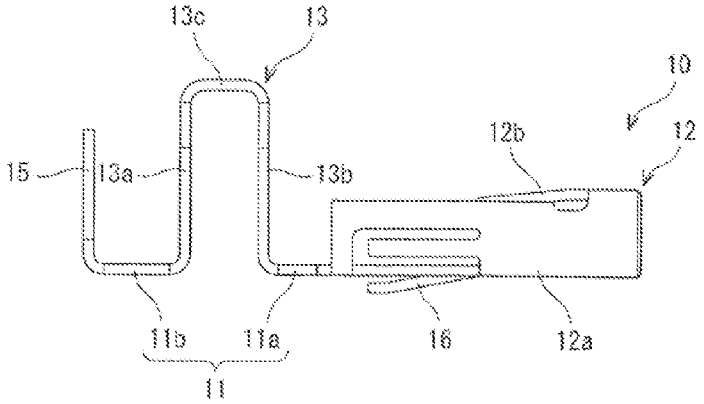
Fig. 5(C)
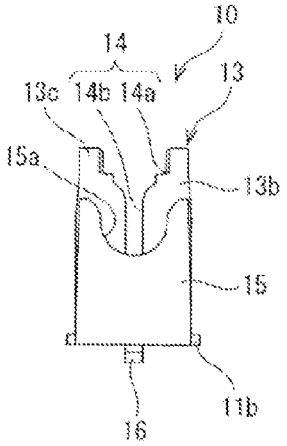
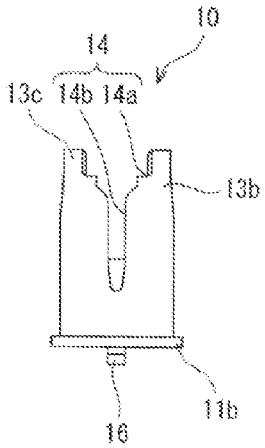
Fig. 5(D)

INSULATION DISPLACEMENT CONTACT AND CONNECTOR

CROSS-REFERENCE TO RELATED APPLICATIONS

This application is a continuation of International Patent Application No. PCT/JP2013/005908 filed Oct. 3, 2013 which claims priority under 35 U.S.C. §119(a)-(d) or (f) to Japanese Patent application No. 2012-240798, filed Oct. 31, 2012.

FIELD OF THE INVENTION

The invention is generally related to an insulation displacement connection (IDC) contact, and, more specifically, an electrical connector having an IDC contact.

BACKGROUND

Conventionally, an electrical connector is widely used for interconnecting electrical wires or an electrical wire and a terminal. A variety of contacts types, such as a crimping type contact and an IDC contact type contact, may be used as a method of connection to an electrical wire. IDC contacts are widely utilized, in part, because of their operational efficiency, in particular, an ability to connect a plurality of electrical wires to a plurality of contacts at once.

A conventional IDC contact generally has a single or a pair of IDC plates, and an electrical wire is connected to the IDC plate in an IDC manner. However, if a tension due to vibrations, an impact, or the like, acts on an electrical wire connected to the IDC contact, a force may act directly on an IDC member, thereby causing an incomplete connection of the electrical wire.

Many attempts have been made to solve the problem of an incomplete connection of the electrical wire to the conventional IDC contact. For example, Japanese Patent No. H04-88662U discloses a conventional IDC contact 101 shown in FIG. 9.

The IDC contact 101 has an elongated base plate 110 extending along a longitudinal axis. A substantially-box-like contact mating portion 120 for receiving a complimentary mating contact (not shown) is positioned at a mating end of the base plate 110. An IDC member 130 is positioned at a substantially-central location along the longitudinal axis of the base plate 110, and a crimping portion 140 is positioned at an opposite terminating end of the base plate 110.

The IDC member 130 includes a pair of IDC plates 131, 132 located so as to be separated by a predetermined distance along the longitudinal axis. Each of the IDC plates 131 is positioned proximate to the mating end and each of the IDC plates 132 is positioned proximate to the terminating end. Additionally, each of the IDC plates 131,132 extends in a direction orthogonal the longitudinal axis, and in a height direction from the base plate 110. In each IDC plate 131, 132, an insulation cutting slit 131*a*, 132*a* is formed so as to extend downward from an upper end along the length of the place 131,132.

The crimping portion 140 has a pair of offset wire crimping bases 141, 142 extending from both sides of the base plate 110, being formed in parallel with the base plate 110. The crimping portion 140 also has a pair of crimping arms 143, 144 corresponding to the wire crimping bases 141, 142, each rising from the opposite sides of the base plates 110. The pair of wire crimping bases 141, 142 have a function to adjust a vertical position of the crimping portion 140 according to the positions of the IDC slits 131*a*, 132*a* of the pair of IDC plates 131, 132 of the IDC member 130.

An electrical wire (not shown) is connected to the IDC member 130 of the IDC contact 101, and an outer insulation layer of the electrical wire is crimped and fixed by the crimping portion 140. In the regard, when a tension due to vibrations, an impact, or the like acts on the electrical wire connected to the IDC contact 101, a force can be prevented from directly acting on the IDC portion 130 by the crimping portion 140. Further, the electrical wire connected to the IDC member 130 and crimped and fixed to the crimping portion 140, becomes substantially in alignment with the pair of wire crimping bases 141, 142. Thereby, a stress on the electrical wire can be minimized.

However, the conventional IDC contact 101 shown in FIG. 9 has the following problems. Firstly, the pair of wire crimping bases 141, 142 in the crimping portion 140 are positioned so as to be offset along the longitudinal axis of the base plate 110. Secondly, the pair of crimping arms 143, 144 are positioned so as to correspond to the wire crimping bases 141, 142 and are likewise positioned offset along the longitudinal axis of the base plate 110. Therefore, a space occupied by the crimping portion 140 along the longitudinal axis in which the base plate 110 extends, is large, requiring the electrical connector in which the IDC contact 101 is housed to correspondingly be much larger.

SUMMARY

An insulation displacement connection contact has a base plate extending along a longitudinal axis and having a mating end and an opposite terminating end. The base plate has a contacting portion positioned proximate to the mating end, a plate-like wire supporting portion integrally extending outward from the base plate at the terminating end, and an insulation displacement connection member positioned between the contacting portion and the wire supporting portion, proximate to the terminating end.

BRIEF DESCRIPTION OF THE DRAWINGS

The invention will now be described by way of example, with reference to the accompanying Figures, of which:

FIG. 5(A) is a right side elevation view of the IDC contact;

FIG. 5(B) is a left side elevation view of the IDC contact;

FIG. 5(C) is a rear elevation view of the IDC contact;

FIG. 5(D) an elevation view seen from arrow 5D in FIG. 5(A);

DETAILED DESCRIPTION OF THE EMBODIMENT(S)

Figure 1A:
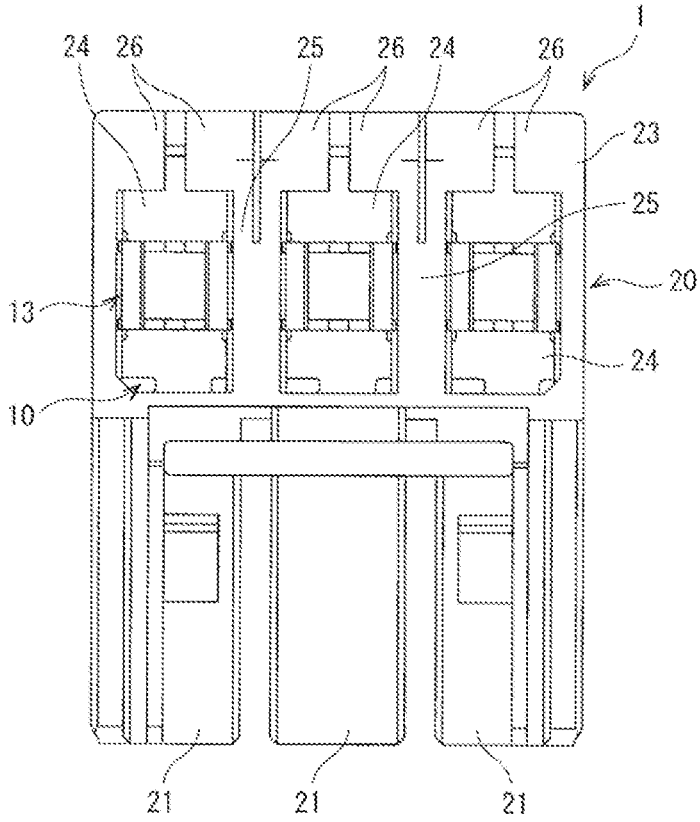
FIG. 1(A) is a plan view of an electrical connector.

An embodiment of an electrical connector 1 is shown in FIG. 1(A)-FIG. 3. The connector 1 has a plurality of IDC contacts 10, and a housing 20 that receives and holds the IDC contacts 10 therein. In the embodiment, the connector 1 has three IDC contacts 10. However in other embodiments, the connector 1 may have 1, 2, 4, or more IDC contacts 10.

Each IDC contact 10 has an elongated base plate 11 extending along a longitudinal axis, with each IDC contact 10 being formed by stamping and forming a conductive metal sheet. The base plate 11 has a mating end and an opposite terminating end.

Figure 4A:
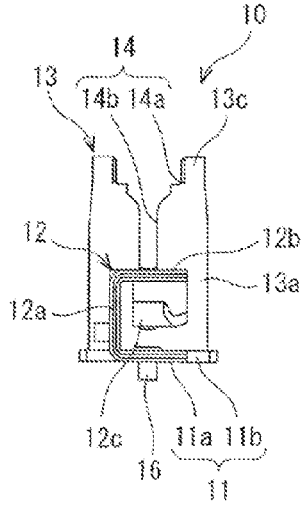
FIG. 4(A) is a front elevation view of an IDC contact.
Figure 4B:
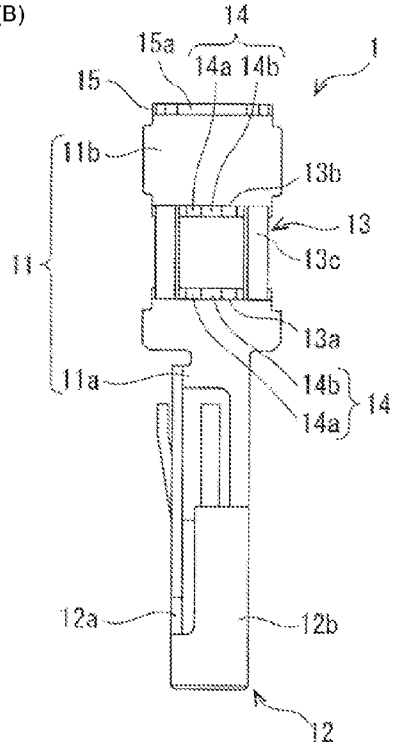
FIG. 4(B) is a plan view of a top of the IDC contact.
Figure 4C:
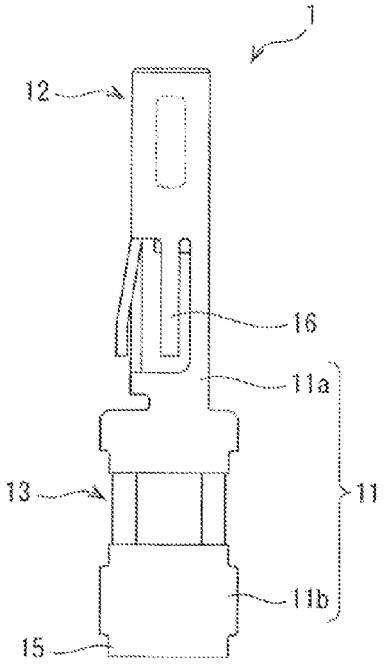
FIG. 4(C) is a plan view of a bottom of the IDC contact.

In an embodiment, shown in FIG. 4(C), the base plate 11 has a first base plate 11*a* and a second base plate 11*b*. The first base plate 11*a* is proximate to the mating end of the IDC contact 10, having a first length extending along the longitudinal axis and a first width extending perpendicular to the longitudinal axis. The second base plate 11*b* is proximate the terminating end of the IDC contact 10, having a second length extending from a terminating end side of the first base plate 11*a* along the longitudinal axis, and a second width extending perpendicular to the longitudinal axis. The second width of the second base plate 11*b* is great than the first width of the first base plate 11*a*.

A contacting portion 12 is positioned on the mating end side of the first base plate 11*a*, extending from the mating end side of the first base plate 11*a*, and making contact with a complimentary mating contact C (see FIG. 6) at the mating end of the base plate 11.

In an embodiment shown in FIG. 4(A), the contacting portion 12 is substantially C-shaped, and includes the first base plate 11*a*, a first side wall 12*a* bent upward from an edge of the first base plate 11*a*, and a top plate portion 12*b* bent from an upper edge of the first side wall 12*a* to extend substantially in parallel with the first base plate 11*a*.

Figure 3:
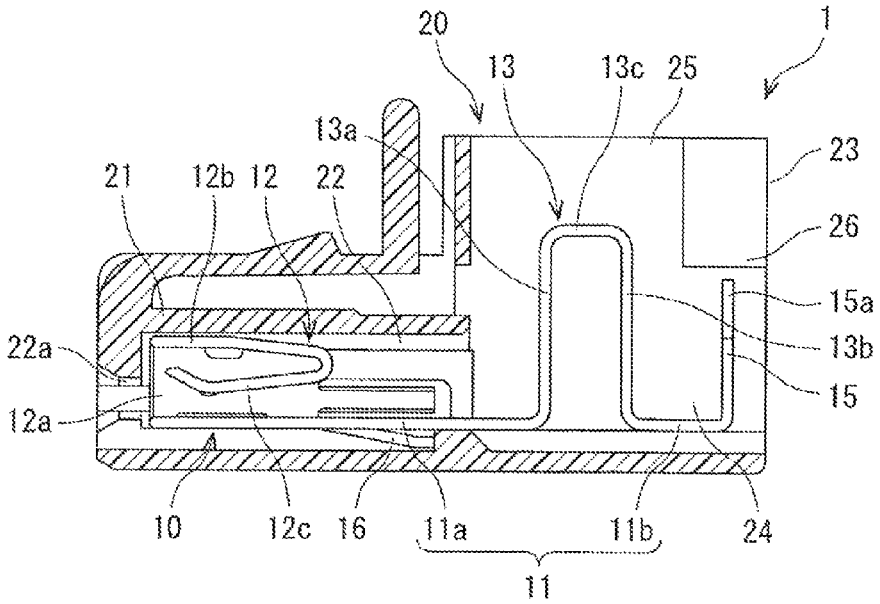
FIG. 3 is a cross-sectional view of the electrical connector taken along line 3-3 in FIG. 1(B)

In the embodiments shown in FIGS. 3 and 5(A), a resilient contacting member 12*c* is positioned on a mating end side of the top plate portion 12*b*, extending firstly towards the terminating end side of the first base plate 11*a* before bending to extend forward towards the mating end of the first base plate 11*a*. In the embodiment shown in FIG. 6, the mating contact C is inserted into the mating end of the contacting portion 12, where the mating contact C comes in contact with the resilient contacting member 12*c*, and the resilient contacting member 12*c* elastically deforms.

An IDC member 13 for connecting an electrical wire W (see FIG. 6) in an IDC manner is positioned at a central region of the second base plate 11*b* along the longitudinal axis. Namely, the IDC member 13 is positioned closer to the terminating end side of the second base plate 11*b* than the resilient contacting member 12*c*. In the embodiments shown in FIGS. 5(A) and 6, the IDC member 13 has a first IDC plate portion 13*a* extending upward, perpendicular to the longitudinal axis, from the mating end side of the second base plate 11*b*, and a second IDC plate portion 13*b* extending upward, perpendicular to the longitudinal axis, from the terminating end side of the second base plate 11*b*. The first IDC plate portion 13*a* and the second IDC plate portion 13*b* are separated by a predetermined distance along the longitudinal axis and face each other, and their upper ends are coupled to each other via a coupling portion 13*c*. As shown in the embodiment of FIGS. 4(A) and 4(B), a cutting 14 is formed in each of the first IDC plate portion 13*a* and the second IDC plate portion 13*b*. Each cutting slit 14, as shown in FIG. 4(A) and FIGS. 5(C), 5(D), has a pair of opposite insulation cutting edges 14*a* on the upper end of the first IDC plate portion 13*a* or the second IDC member 13*b* so as to extend downward and have a first width. Further, each cutting slit 14 has a pair of conductor contacting edges 14*b* cut from a lower end of the insulation cutting edge 14*a* so as to extend downward and have a second width that is narrower than the first width. The insulation cutting edges 14*a* bite into an insulating cover of the electrical wire W when the electrical wire W is connected in an IDC manner, and, as the wire W is pushed deeper into the cutting slit 14, the conductor contacting edges 14*b* bites into a core of the electrical wire W when the electrical wire W is connected in an IDC manner. The insulation cutting edges 14*a* of the first IDC plate portion 13*a* and the insulation cutting edges 14*a* of the second IDC plate portion 13*b*, as shown in the embodiments of FIGS. 4(A) and 4(B), communicate with each other through a notch cut longitudinally through the coupling portion 13*c*.

Figure 2A:
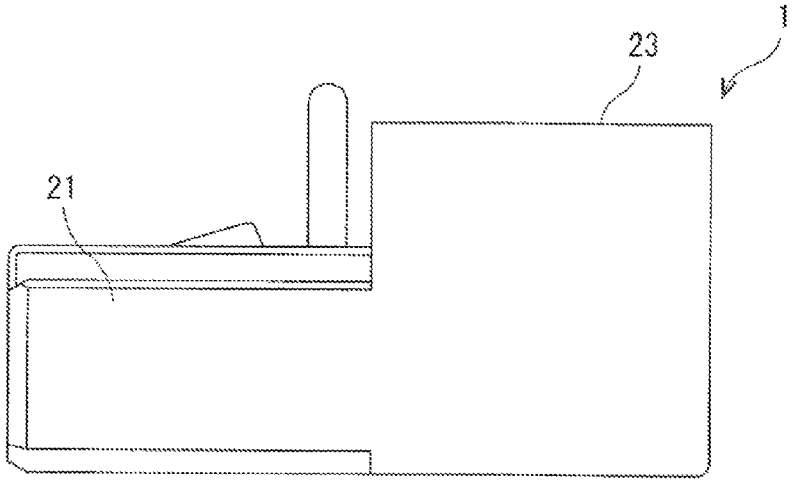
FIG. 2(A) is a right side elevation view of the electrical connector.
Figure 2B:
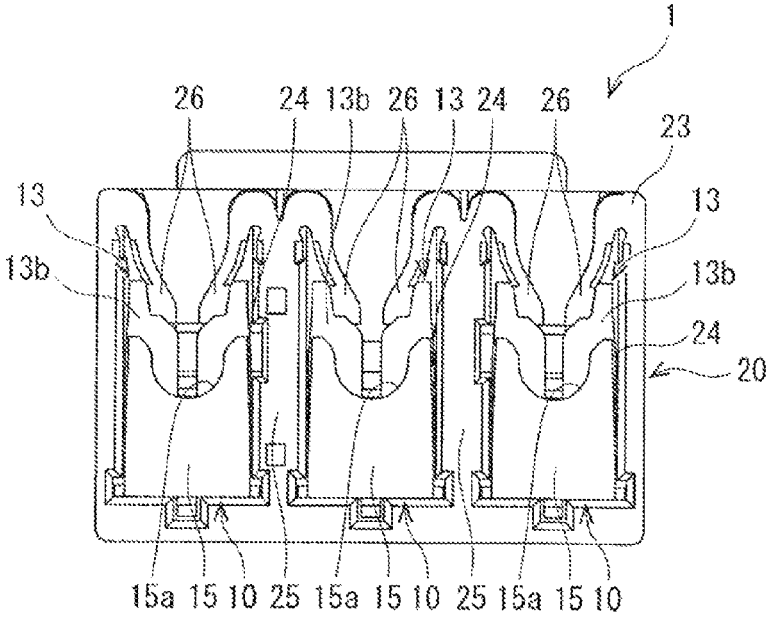
FIG. 2(B) is a rear elevation view of the electrical connector.
Figure 6:
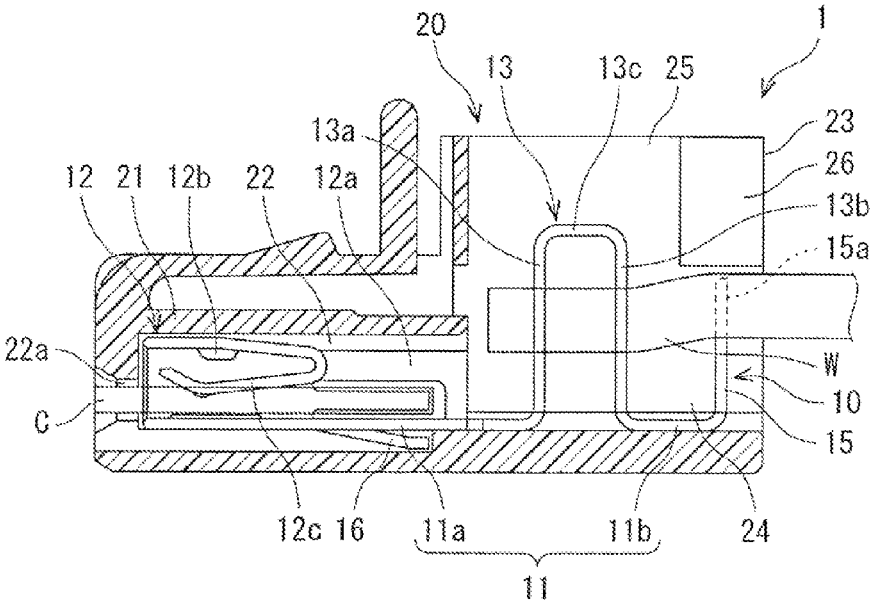
FIG. 6 is a cross-sectional view of the connector shown in FIG. 1.
Figure 7:
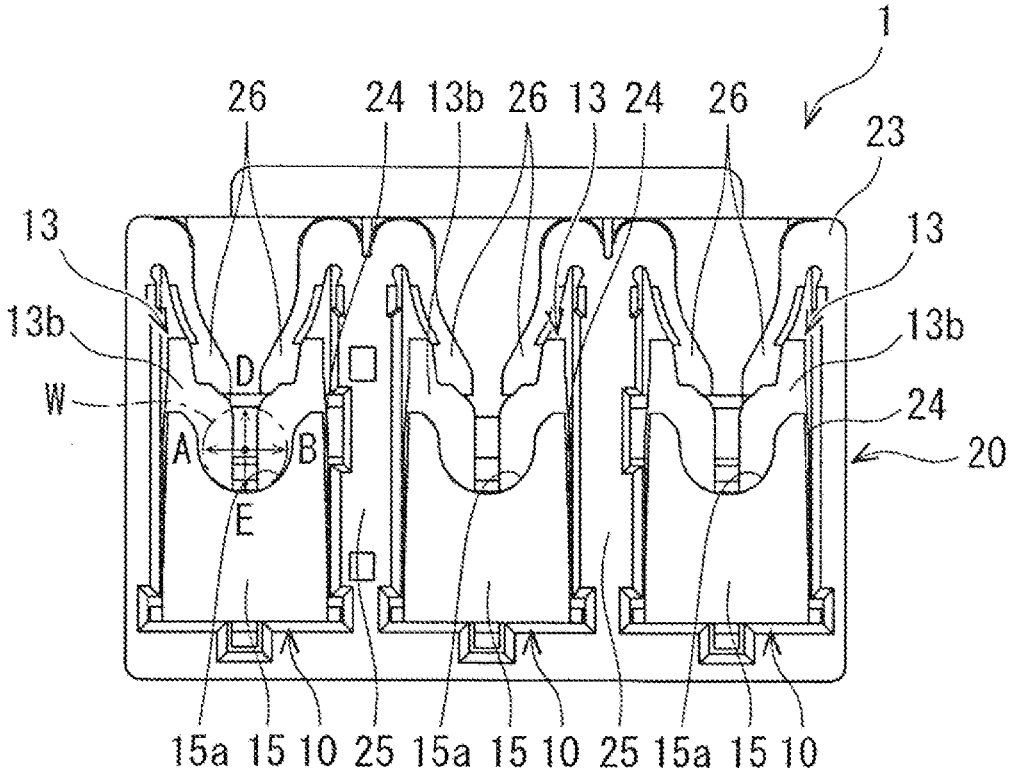
FIG. 7 is a rear elevation view of the electrical connector shown in FIG. 1 having an electrical wire, indicated by a dot-and-dash line, supported by a-wire supporting member.

A plate-like wire supporting portion 15 extends perpendicularly upward from the terminating end side of the second base plate 11*b* to support an inserted electrical wire W. The wire supporting portion 15 is integrally connected at the terminating end of the second base plate 11*b* of the base plate 11 and is bent upwards. In addition, the wire supporting portion 15, as shown in the embodiments of FIGS. 2(B), 5(C), and 7, has a wire receiving notch 15*a* positioned on an upper end that is cut in a substantially semicircular shape having a slightly larger diameter than the electrical wire W. As shown in the embodiments of FIGS. 6 and 7, when the electrical wire W is connected to the IDC member 13, the electrical wire W is positioned within the wire receiving notch 15*a* from above the wire supporting portion 15, so that a downward movement (arrow E) and a lateral movement (arrows A and B) of the electrical wire W on the terminating end side of the IDC member 13 is restricted.

In the embodiments shown in FIGS. 3, 4(A), 4(B), 5(A), 5(B), 5(C), 5(D), and 6, a contact lance 16 is positioned on the first base plate 11*a* of each IDC contact 10, extending downwards from the first base plate 11*a*, away from the resilient contacting member 12*c*.

Figure 1B:
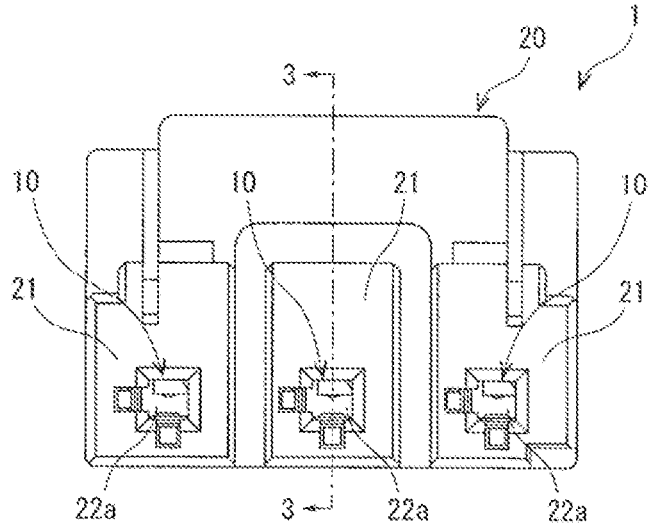
FIG. 1(B) is a front elevation view of the electrical connector.

In the embodiments shown in FIGS. 1(A) and 1(B), the housing 20 has a housing body 23, and a plurality of contact receiving passageways 21 extending through the housing body 23 along the longitudinal axis. The housing 20 is formed by molding an insulating synthetic resin.

Each contact receiving passageway 21, as shown in FIG. 3, includes a contacting portion receiving space 22 receiving the contacting portion 12 of each IDC contact 10. On a mating end of the housing 20, a plurality of mating contact receiving holes 22*a* extend through a mating end wall of the housing 20 (see FIGS. 1(B) and 3). Each mating contact receiving hole 22*a* is in communication with each the contacting portion receiving space 22.

Each contact receiving passageway 21 further includes a plurality of IDC member receiving spaces 24 extending along the longitudinal axis, with each being in communication with one of the contacting portion receiving spaces 22. Each IDC member receiving space 24, as shown in FIGS. 1(A), 2(B), and 3, has a greater volume than the contacting portion receiving space 22, having a greater height extending perpendicular to the longitudinal axis. In addition, adjacent IDC member receiving spaces are separated by partition walls 25 extending along the longitudinal axis.

A pair of wire movement restricting portions 26 are positioned on opposing partition walls 25 on both sides of each IDC member receiving space 24, as shown in the embodiments of FIGS. 1(A), 2(B), and 3. For the outermost IDC member receiving space 24, an outer wall of the housing body 23 and the partition wall 25 have the pair of wire movement restricting portions 26. Each wire movement restricting portion 26 is positioned on a terminating end side of the partition wall 25 (or the outer wall), above each IDC member receiving space 24. The pair of wire movement restricting portions 26 are opposed to face each other. The pair of wire movement restricting portions 26 are positioned above the wire supporting portion 15 of the IDC contact 10 positioned in the housing 20, and restrict an upward movement indicated by arrow D (see FIG. 7) of the electrical wire W located within the wire receiving notch 15*a*. Each wire movement restricting portion 26 is bent obliquely downward at an upper end part of the partition wall 25 (or the outer wall), and is elastically deformable.

An assembling method of the connector 1 will now be described. The contacting portion 12 of each IDC contact 10 is inserted into each contacting portion receiving space 22 from a terminating end of the housing 20. Then, the contact lance 16 provided on each IDC contact 10, as shown in FIG. 3, is caught by the housing 20, so that each IDC contact 10 is fixed in the housing 20. After each IDC contact 10 is fixed in the housing 20, the IDC member 13 and the wire supporting portion 15 of each IDC contact 10 are positioned within each IDC member receiving space 24. In particular, the wire supporting portion 15 is positioned within each IDC member receiving space 24, below the wire movement restricting portion 26. When each electrical wire W is connected to each IDC contact 10, each electrical wire W is connected to the IDC member 13 of each IDC contact 10 located within the IDC member receiving space 24 from above each IDC member receiving space 24 in an IDC manner. Upon the connection in an IDC manner, the insulation cutting edge 14*a* of the IDC member 13 bites into the covering of the electrical wire W, and further, the conductor contacting edge 14*b* bites into the core of the electrical wire W.

Simultaneously with the connection of each electrical wire W to the IDC member 13, each electrical wire W passes through between the pair of wire movement restricting portions 26, and is positioned within the wire receiving notch 15*a* of the wire supporting portion 15 of each IDC contact 10. Since each wire movement restricting portion 26 is elastically deformable, each electrical wire W relatively easily passes between the pair of wire movement restricting portions 26.

Once each electrical wire W is positioned within the wire receiving notch 15*a* of each wire supporting portion 15, the downward movement (arrow E) and the lateral movements (arrow A and arrow B) are restricted by the wire supporting portion 15, as shown in FIG. 7. Thereby, a more terminating end side than the IDC member 13 of each electrical wire W is supported by each wire supporting portion 15. Further, once each electrical wire W is positioned within the wire receiving notch 15*a* of each wire supporting portion 15, the upward movement (arrow D) of each electrical wire W is restricted by the pair of wire movement restricting portions 26 disposed in the housing 20.

Thus, the IDC contact 10 and the connector 1 according to the embodiment, the more terminating end side of the electrical wire W connected to the IDC member 13 can be supported by the wire supporting portion 15. Thereby, when a tension due to vibrations, an impact, or the like, acts on the electrical wire W connected in an IDC manner, the force can be prevented from acting directly on an IDC contact part. As such, even when repetitive vertical or lateral tensions act on the more terminating side than the IDC member 13 of the electrical wire W, the force does not act directly on the IDC contact part, so that the electrical wire W can be prevented from coming off of the IDC member 13 of each IDC contact 10.

Since the wire supporting portion 15 has a plate-like shape extending vertically upward from the base plate 11 and supporting the electrical wire W, a space occupied by a portion supporting the electrical wire W along the longitudinal axis in which the base plate 11 extends can be reduced. Thereby, each IDC contact 10, and thus the connector 1, can be reduced in size.

The IDC contact 10 is formed by stamping and forming a conductive metal sheet, and the wire supporting portion 15 is positioned integrally with the base plate 11, the contacting portion 12, and the IDC member 13. Therefore, the wire supporting portion 15 can be produced by an easy manufacturing process.

The IDC contact 10 has the wire supporting portion 15 with the wire receiving notch 15*a* cut from the upper end of the wire supporting portion 15, and the electrical wire W is positioned within the wire receiving notch 15*a* so that the downward and lateral movements of the electrical wire W are restricted. Therefore, the electrical wire W can be positioned within the wire receiving notch 15*a* of the wire supporting portion 15 from above. Thus, the electrical wire W can be supported by locating the electrical wire W within the wire receiving notch 15*a* of the wire supporting portion 15 simultaneously with the operation of cutting the insulation while connecting the electrical wire W to the IDC member 13 in an IDC manner. Therefore, an improvement of efficiency of operations of connecting the electrical wire W and supporting the electrical wire can be achieved.

Figure 9:
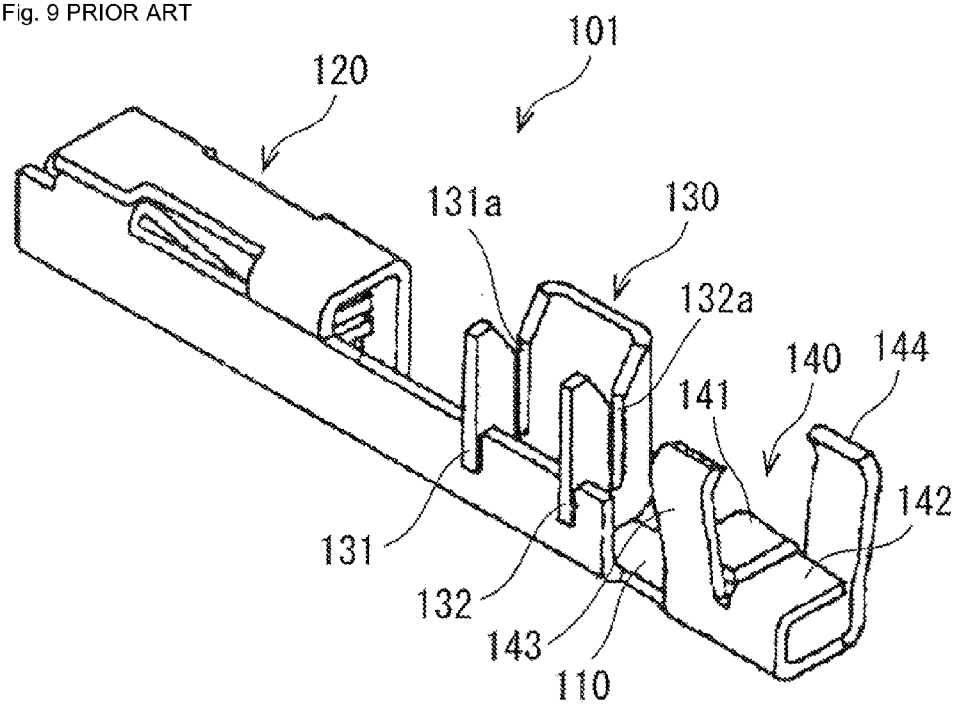
Fig. 9 PRIOR ART
FIG. 9 is a perspective view of a conventional IDC contact.

The above embodiments are contrasted with the conventional IDC contact 101 shown in FIG. 9, where an additional operation of crimping and fixing an electrical wire with the crimping portion 140 is required. Additionally, an operation of insulation cutting and displacement for connecting the electrical wire to the IDC member 130 in an IDC manner is much more complicated. In further contrast, in the case of the IDC contact 10 according to the above embodiments, the electrical wire W is supported by positioning the electrical wire W within the wire receiving notch 15*a* of the wire supporting portion 15 simultaneously with the operation of insulation displacement connecting the electrical wire W to the IDC member 13. Therefore, the crimping process becomes unnecessary, so that the improvement of efficiency of operations of connecting the electrical wire W and supporting the electrical wire can be achieved.

In addition, the housing 20 of the connector 1 has the wire movement restricting portion 26 positioned above the wire supporting portion 15 for restricting the upward movement of the electrical wire W. Therefore, since the restriction of the upward movement of the electrical wire W by the wire movement restricting portion 26 can be performed in addition to the restriction of the downward and lateral movements of the electrical wire by the wire supporting portion 15, an effect of supporting the electrical wire W can be increased.

Figure 8:
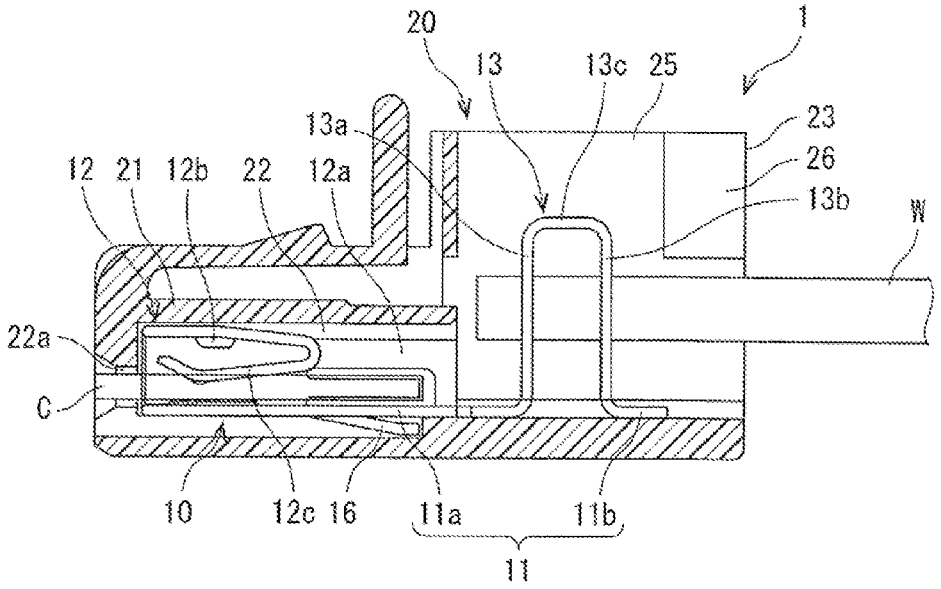
FIG. 8 is a cross-sectional view of the electrical connector with an IDC contact having the electrical wire unsupported by a wire supporting portion.

It should be noted that FIG. 8 shows a connector using an IDC contact which does not include a wire supporting portion, with an electrical wire connected to an IDC member in an IDC manner. In FIG. 8, the same members as members shown in FIG. 6 are denoted by the same reference signs, and the description thereof may be omitted.

In the case of the connector 1 shown in FIG. 8, a wire supporting portion is not positioned in each contact 10. Therefore, when the electrical wire W is connected to the IDC member 13 of each contact 10 in an IDC manner, the downward and lateral movements of the more rear side than the IDC member 13 of the electrical wire W cannot be prevented. Only the upward movement of a more rear-side part than the IDC member 13 of the electrical wire W can be restricted by the pair of wire movement restricting portions 26 provided in the housing 20. Therefore, when a tension due to vibrations, an impact, or the like, acts on the electrical wire W connected in an IDC manner, a force tends to act directly on an IDC contact part. If repetitive vertical or lateral tensions act on the more rear side than the IDC member 13 of the electrical wire W, the electrical wire W may come off of the IDC member 13 of each IDC contact 10.

Hereinabove, various embodiments of the invention have been described, but the invention is not expressly limited to these embodiments, and can be variously changed and/or modified.

For example, the wire supporting portion 15 does not necessarily need to be formed by bending the terminating end of the second base plate 11*b* of the base plate 11, as long as the wire supporting portion 15 is positioned integrally with the IDC contact 10 at a more rear side than the IDC member 13 of the base plate 11. If the wire supporting portion 15 is positioned on the housing 20 side, the wire supporting portion 15 becomes an obstruction to the positioning of the IDC contact 10 is in the housing 20. On the other hand, the invention is free from such an obstruction since the wire supporting portion 15 is positioned on the IDC contact 10.

Further, the wire receiving notch 15*a* formed in the wire supporting portion 15 does not necessarily need to be cut in a substantially semicircular shape having a slightly larger diameter than the electrical wire W, but may, in other embodiments, be other shapes complementary to the shape of the electrical wire W.

What is claimed is:

1. An insulation displacement connection contact comprising:

a base plate extending along a longitudinal axis and having a mating end and an opposite terminating end, the base plate having a contacting portion positioned proximate to the mating end, a plate-like wire supporting portion integrally extending from the terminating end perpendicularly to the longitudinal axis of the base plate, and an insulation displacement connection member positioned proximate to the terminating end between the contacting portion and the wire supporting portion, the insulation displacement connection member including a first plate having a cutting slit, the first plate extending from the base plate parallel to the wire supporting portion.

2. The insulation displacement connection contact of claim 1, wherein a height of the wire supporting portion is lower than a height of the insulation displacement connection member.

3. The insulation displacement connection contact of claim 1, wherein the wire supporting portion has a wire receiving notch positioned on an outermost end from the base plate.

4. The insulation displacement connection contact of claim 3, wherein the first plate is positioned proximate to the mating end of the base plate, and the insulation displacement connection member further includes a second plate positioned proximate to the terminating end of the base plate.

5. The insulation displacement connection contact of claim 4, wherein the first plate and the second plate are separated by a distance along the longitudinal axis and face each other.

6. The insulation displacement connection contact of claim 5, wherein the second plate has a cutting slit, the cutting slit on each of the first plate and the second plate extending along a central region perpendicular to the longitudinal axis.

7. The insulation displacement connection contact of claim 6, wherein each cutting slit has:

a pair of opposing insulation cutting edges positioned a first distance apart on an outer end; and a pair of opposing conductor contacting edges positioned a second distance apart on a lower end.

8. The insulation displacement connection contact of claim 7, wherein the first distance is greater than the second distance.

9. The insulation displacement connection contact of claim 8, wherein the insulation displacement connection member further includes a coupling portion connecting the outer ends of the first plate and the second plate.

10. The insulation displacement connection contact of claim 9, wherein the insulation cutting edges of the first plate and the insulation cutting edges of the second plate are in communication with each other through a notch cut longitudinally through the coupling portion.

11. The insulation displacement connection contact of claim 1, wherein the contacting portion includes:

a first base plate;

a first sidewall bent upward from an edge of the first base plate; and a top plate bent from an upper edge of the first sidewall to extend substantially parallel with the first base plate.

12. The insulation displacement connection contact of claim 11, wherein the contacting portion is substantially C-shaped.

13. The insulation displacement connection contact of claim 12, wherein a resilient contacting member is positioned on a mating end side of the top plate.

14. The insulation displacement connection contact of claim 13, wherein the resilient contacting member extends firstly towards a terminating end side of the first base plate before bending to extend towards a mating end side of the first base plate.

15. An electrical connector comprising:

a housing having a plurality of contact receiving passageways; and a plurality of insulation displacement connection contacts positioned in the contact receiving passageways, each insulation displacement connection contact having a base plate extending along a longitudinal axis and having a mating end and an opposite terminating end, the base plate having a contacting portion positioned proximate to the mating end, a plate-like wire supporting portion integrally extending from the terminating end perpendicularly to the longitudinal axis of the base plate, and an insulation displacement connection member positioned proximate to the terminating end between the contacting portion and the wire supporting portion, the insulation displacement connection member including a first plate having a cutting slit, the first plate extending from the base plate parallel to the wire supporting portion.

16. The electrical connector of claim 15, wherein each of the contact receiving passageways extend longitudinally through the housing, each having:

a contact portion receiving space on the mating end; and an insulation displacement connection member receiving space on the terminating end.

17. The electrical connector of claim 16, wherein each contact receiving passageway is separated by opposing partition walls.

18. The electrical connector of claim 17, wherein a pair of wire movement restricting portions are positioned on the opposing partition walls on both sides of each insulation displacement connection member receiving space.

19. The electrical connector of claim 18, wherein the pair of wire movement restricting portions are positioned above the wire supporting portion of the base plate.

* * * * *